United States Patent [19]

Graf et al.

[11] Patent Number: 4,662,079

[45] Date of Patent: May 5, 1987

[54] PROCESS AND APPARATUS FOR FORMING CUSTOMIZED FOOTWEAR

[76] Inventors: Peter M. Graf, 566 - 11th Ave., San Francisco, Calif. 94118; Richard M. Stess, 36 Dutch Valley Dr., San Anselmo, Calif. 94960

[21] Appl. No.: 793,492

[22] Filed: Oct. 30, 1985

Related U.S. Application Data

[63] Continuation of Ser. No. 493,282, May 10, 1983, abandoned.

[51] Int. Cl.[4] ..... G01B 11/26

[52] U.S. Cl. ..... 33/512; 33/515; 33/3 R; 33/6

[58] Field of Search ..... 33/143 R, 143 L, 147 E, 33/147 L, 147 N, 172 E, 511, 512, 515, 3 R, 3 A, 3 B, 6; 12/142 R, 142 N, 142 P; 264/220, 222, 223, DIG. 30; 128/595, 80 DB; 125/2

[56] References Cited

U.S. PATENT DOCUMENTS

| | | | |
|---|---|---|---|
| 1,569,352 | 1/1926 | Brace | 33/147 D |
| 1,646,194 | 10/1927 | Fischer . | |
| 1,854,838 | 4/1932 | Hartsough | 33/172 E X |
| 2,120,987 | 6/1938 | Murray | 425/2 X |
| 2,177,304 | 10/1939 | Murray . | |
| 2,332,000 | 10/1943 | Murray . | |
| 2,472,348 | 6/1949 | Skinner | 33/172 E X |
| 2,547,419 | 4/1951 | Sugarman et al. . | |
| 2,568,292 | 9/1951 | Murray . | |
| 2,572,680 | 10/1951 | Treat . | |
| 2,734,276 | 2/1956 | Weaver | 33/148 D |
| 2,856,633 | 10/1958 | Murray . | |
| 2,877,502 | 3/1959 | Murray . | |
| 2,887,727 | 5/1959 | Murray . | |
| 2,891,285 | 6/1959 | Kaplan | 264/223 |
| 2,907,067 | 10/1959 | Burger . | |
| 2,955,326 | 10/1960 | Murray . | |
| 2,961,714 | 11/1960 | Murray . | |
| 4,139,337 | 2/1979 | David | 425/2 |

OTHER PUBLICATIONS

Bulletin of Prosthetics Research, Spring, 1969, pp. 214 through 234, "UC-BL Shoe Insert, Casting and Fabrication" and pp. 88 through 145, "The Orthotic Prescription Derived from a Concept of Basic Orthotic Functions".

*The Foot Book Advice for Athletes,* Harry F. Hlavac, M.Ed., D.P.M., World Publications, pp. 30, 31 and 98.

*The Running Foot Doctor—How We Work,* pp. 18 through 38.

*Journal of Podiatry Association,* Podiatric Sports Medicine, "The Biomechanical Basis of Skiing", vol. 64, No. 1, Jan. 1974, pp. 71 through 79.

*Primary Examiner*—Harry N. Haroian

*Attorney, Agent, or Firm*—Manfred M. Warren; Robert B. Chickering; Glen R. Grunewald

[57] ABSTRACT

A process and apparatus for forming customized footwear, such as shoes, boots or inner bladders for shoes or boots, and particularly an athletic shoe or boot, is disclosed in which an impression of the foot is used to make a positive mold, around which the shoe, boot or bladder is constructed. In the improved process a range-of-motion measuring apparatus is used to accurately determine the neutral position of the bone structure of the rearfoot complex of the foot. The foot is maintained in that position by means of the apparatus while the impression or casting of the foot is being made. The process provides a shoe, boot or inner liner or bladder therefor which will evenly support the foot in a neutral position. The range-of-motion measuring apparatus includes a beam generating laser that is directed toward a mirror mounted on the leg of the person being fitted. The mirror, in turn, is directed to reflect the laser beam onto a measuring device, such as a scale, which can be used to electronically or visually measure leg rotation during pronation and supination of the foot and, accordingly, to position the bone structure of the foot in its neutral position.

4 Claims, 11 Drawing Figures

PROCESS AND APPARATUS FOR FORMING CUSTOMIZED FOOTWEAR

This application is a continuation of application Ser. No. 493,282 filed May 10, 1983 now abandoned.

BACKGROUND OF THE INVENTION

Study of the biomechanics of the bone structure of feet has revealed that, while everyone has a so-called "neutral position" of the rearfoot complex of the bones in their feet, this neutral position will vary from person to person. The neutral position of the rearfoot complex long has been known to be the position at which the foot is neither pronated nor supinated. When the foot is in the neutral position, it is oriented in the most efficient position to accommodate the full range of foot rotation during locomotion (walking, running, skiing, etc.). The weight of the individiaul is supported by the bone structure of the foot most effectively and with the least stress on muscles in the foot and leg when the foot is in the neutral position. The neutral position does not necessarily occur when the calcaneous bone (heel bone) is vertically aligned with the tibia and fibula (leg bones).

Understandably, but unfortunately, the manufacture of ready-to-wear shoes and ski boots, and even customized shoes and boots, largely has disregarded the variation from individual to individual of the neutral position. Thus, everyone is assumed to have the same general neutral position, usually when the plantar surface is horizontal and the calcaneous bone is vertically aligned with the tibia and fibula. This simplistic approach is adequate for most of the population under most conditions, but there are a growing number of situations in which this approach causes or exacerbates problems.

First, those individuals who have neutral positions which deviate substantially from the assumed "normal" neutral position can experience considerable discomfort during standing, walking, running or skiing when wearing ready-to-wear shoes or ski boots. The construction of these shoes or boots will displace the rearfoot complex of the foot from the neutral position for that individual and place extra stress on the foot muscles.

A second area that has gained significance is in connection with athletics. Small deviations from the assumed "normal" neutral position occur in almost everyone, and these deviations can become significant and cause substantial discomfort if the foot is subjected to high stress, for example, as a result of jogging, running or skiing.

There are at least ten million people in the United States who are involved to some degree in running, jogging, or skiing, and the number is constantly growing. While a significant number of these people participate in competitive athletics, the vast majority participate for their own satisfaction and/or heath. Even the non-competitive athlete, however, will engage in many repetitions of his sport during the course of a year. Unfortunately, the equipment, and particularly ready-to-wear shoes and boots, can combine with an athlete's enthusiasm for his sport to produce a wide range of injuries or maladies. Thus, arch strain, heel spur syndrome, runner's knee, shin splints, tendonitis, upper leg and hip strain and even lower back problems can be, and often are, detrimental "side effects" of highly bereficial cardio-pulmonary exercises of jogging, running and skiing.

There are currently a myriad of different ready-to-wear shoes and ski boots which are recommended and extensively advertised as being designed specifically for running or skiing and the problems associated therewith. Each year, e.g., RUNNERS' WORLD publishes an issue of their magazine devoted exclusively to the evaluation of various brands of running shoes. While the evaluation is interesting, it involves a high degree of subjectivity. Commerically available running shoes generally follow relatively conventional formulae in their construction, with cosmetics being as important as almost any other factor in inter-brand competition.

The biomechanical aspects of running and other foot-based athletic endeavors have been studied in some detail. In the January, 1974 issue of the journal of the *American Podiatry Association* the biomechanical basis of skiing and the affect of deformities or irregularities in the bone structure of the foot were studied, particularly in connection with the desirability of canting the ski boot and using in-boot orthotic devices. The book entitled *THE FOOT BOOK, ADVICE TO RUNNERS* examines the biomechanics of walking, jogging, running and sprinting, together with the effect of abnormalities of the neutral position of the rearfoot complex of the bone structure on these biomechanical functions.

These articles conclude that orthotic devices, positioned in the shoe of the runner by a podiatrist, can be of significant assistance in overcoming and eliminating chronic runner's foot, knee and leg problems. Such orthotic devices may include rearfoot posts, arch supports and forefoot canting devices, to name a few. Similarly, podiatrists have used in-shoe orthotic devices to enable non-athletes with severe variation from the normal neutral position to stand and walk comfortably. The effort in connection with orthotic devices is to attempt to position the foot in so-called "neutral" position. Thus, orthotic devices seek to bring or build the inner sole of the shoe up to the foot, when it is in the neutral position, and to have the foot function around this neutral position.

When this alignment or support of the foot is accomplished by an orthotic device mounted inside the shoe, care has to be taken that the combination of the orthotic devices and the shoe or produces the desired result. Many running shoes, e.g., do not come in variable widths and will not have sufficient room to accommodate an orthotic device. Sometimes the flexibility of the orthotic device must be varied so that the combined flexibility of the orthotic device and the shoe is optimal. These problems usually eventually can be overcome to a major degree by a podiatrist through variation of the orthotic appliances and the running shoes employed by the runner, but the care and assistance of a trained professional usually is required. Most runners, however, do not go to the podiatrist until the maladies are severe, and all would prefer to avoid a post-injury experimentation experience.

Another approach to the problem of providing a better shoe or boot for ordinary or athletic use has been to custom mold the shoe, boot or inner boot bladder around the foot of the wearer. It has been believed to be particularly useful to be able to support the entire bottom or plantar surface of the individual's foot by custom molding an insole to that surface. The shoe, boot or bladder upper can be molded or otherwise formed to conform to the specific configuration of the upper part of the foot of the user. The patent literature is replete with molding processes for the formation of shoes that are customized to an individual's foot, and the following United States patents are typical of such prior art processes: U.S. Pat. Nos. 2,961,714, 2,955,326, 2,961,714, 2,955,326, 2,907,067, 2,877,502, 2,856,633, 2,572,680, 2,568,292, 2,547,419, 2,332,000, 2,177,304, 2,120,987, 1,646,194.

While these prior art processes describe various methods and techniques for obtaining an impression of the human foot and forming a shoe based upon such an impression, the thrust of these processes is to obtain better foot support which mates with the bottom surface of the foot, and little or no consideration is given to the relative movement of the sketetal structures of the rear foot.

OBJECTS AND SUMMARY OF THE INVENTION

A. Objects of the Invention

Accordingly, it is an object of the present invention to provide a process and apparatus for the formation of a customized shoe, boot or inner bladder therefor which will support the foot in a biomechanically sound manner.

It is another object of the present invention to provide a process and apparatus for the formation of an athletic shoe or boot in which the need for the use of an orthotic device is substantially eliminated.

Still another object of the present invention is to provide a process and apparatus for the formation of a customized shoe, boot or the like in which the foot is supported for minimum muscle strain during standing, walking, running, jogging, skiing or the like.

Another object of the present invention is to provide a process and apparatus for the formation of a customized shoe, boot or bladder in which the benefits of a uniform support of the bottom of the foot are combined with the benefits of proper skeletal alignment.

Another object of the present invention is to provide a process and apparatus for the formation of a customized shoe, boot or bladder therefor which can be practiced by technicians having only a moderate amount of training.

Still another object of the present invention is to provide an apparatus for the formation of a customized shoe, boot or the like which is relatively easy to use, is readily adaptable to any individual, is very accurate, and requires a minimal amount of time for the individual being fitted.

The process and apparatus for forming customized shoes, boots or the like of the present invention has other features of advantage and objects which are set forth and/or will become apparent from the following description of the preferred embodiments and the accompanying drawing.

B. Summary of the Invention

The process for the formation of customized footwear, such as shoe, ski boot or inner bladder for a shoe or boot, of the present invention includes the steps of taking an impression of the foot of the person, producing a positive model of the foot from the impression, and forming the shoe, boot or bladder to conform to the model. The improvement in the process is comprised, briefly, of the steps of positioning the rearfoot complex of the bone structure of the foot in the neutral position by a range-of-motion measuring apparatus at about the start of the step of taking an impression, and thereafter maintaining the bone structure of the rearfoot complex in the neutral position by means of the apparatus until a permanent impression of the foot has been formed. In the preferred form of the invention, the neutral position of the rearfoot complex is accurately determined using a laser beam, mirror and scale apparatus as the range-of-motion measuring device. The mirror is mounted to the leg of the individual and used to direct the beam from the laser onto a scale or sensor means. Rotation of the leg during pronation and supination of the foot causes the mirror to deflect the beam along a scale or sensor to permit computation or location of the neutral position. Additionally, the process includes the steps of forming datum indicia on the impression, transferring the indicia to the positive model, and using the indicia on the model to properly orient the model during formation of the footwear.

DESCRIPTION OF THE PREFERRED EMBODIMENTS

Figure 1:
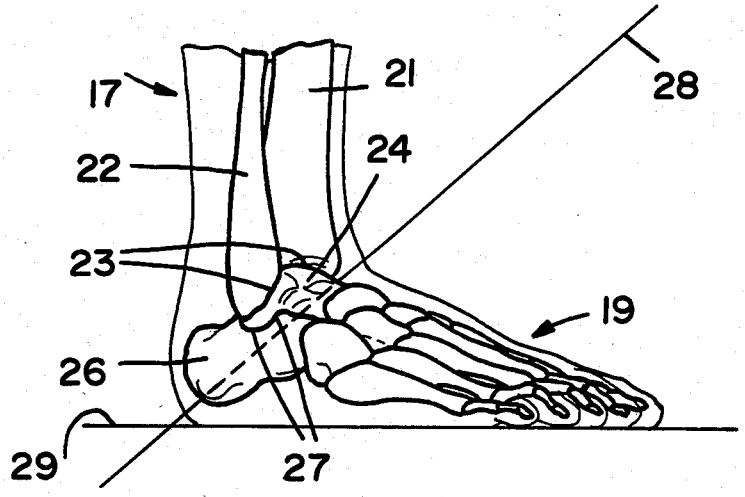
FIG. 1 is a side elevational view of the bone structure of a right foot on a horizontal surface showing the subtalar joint.

Prior to any description of the process and apparatus of the present invention some basic physiological considerations relating to the bone structure of the foot must be set forth. FIG. 1 illustrates the basic bone structure of a normal lower leg, generally designated 17, and foot, generally designated 19. The major leg bones are tibia 21 and fibula 22, which are the lower leg bones between the foot and thigh. Tibia 21 and fibula 22 are supported at ankle joint 23 on talus bone 24. The talus bone in turn rests on the calcaneous bone 26, with the subtalar joint 27 extending between these two bones. As will be apparent, the weight of the individual is transferred from tibia 21 and fibula 22 to talus bone 24 and subsequently to calcaneous bone 26.

The foot may, of course, be pivoted about ankle joint 23, but additionally foot 19 can be rotated about subtalar joint axis 28. It is the ability of the foot bone structure to move at the ankle and subtalar joints which enables the foot to adapt to a wide range of support surfaces 29.

Figure 2:
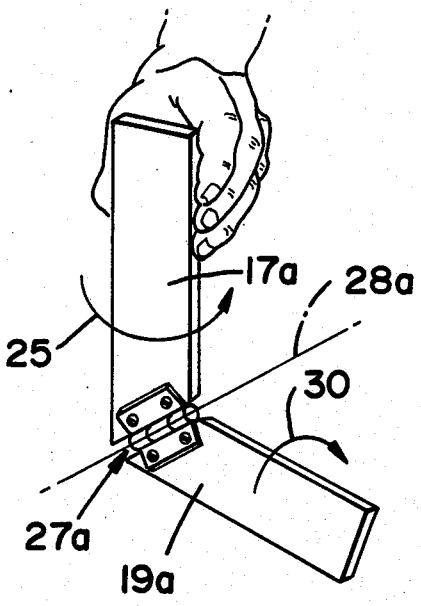
FIG. 2 is a to perspective view of a hinged joint corresponding to the right subtalar joint of FIG. 1 with the hinge (leg) internally rotated.
Figure 3:
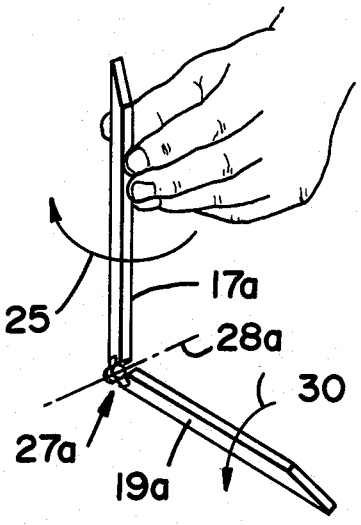
FIG. 3 is a top perspective view corresponding to FIG. 2 with the hing (leg) externally rotated.

As best may be seen in FIGS. 2 and 3, subtalar joint 27 functions essentially as a single axis joint. An analog of this joint is a mitered hinge 27*a*, which connects leg simulating member 17*a* to foot simulating member 19*a* for rotation about axis 28*a*. Axial rotation of leg simulating member 17*a* in the direction of arrows 25 will be directly transmitted through hinge 27*a* to foot similating member 19*a* and cause movement of member 19*a* in the directions indicated by arrow 30. Internal rotation of member 17*a* (FIG. 2) produces pronation (eversion) of member 19*a*. Conversely, external rotation of member 17*a* (FIG. 3) produces supination (inversion) of member 19*a*.

Applying this analog to the actual foot bone structure, the segments of the thigh and leg undergo a series of rotations about the vertical or longitudinally extending axis during normal locomotion. During the stance phase, rotations are possible because of the action of subtalar joint 27. The linkage provided by the subtalar joint requires that pronation or supination of foot 19 accompany the transverse rotations of leg 17. The flexibility or rigidity (stability) of the foot during normal function is dependent on an unlocking and locking mechanism inherent in the foot's structural configuration. The key to the entire mechanism lies in control of calcaneous 26 and its relationship to talus 24. Ideally the foot should be in a "neutral" position (neither pronated nor supinated) when the talus is generally vertically superimposed over the calcaneous (as viewed from the rear of the foot). For most individuals, however, the neutral position is not produced merely by aligning the talus over the calcaneous. Instead, the neutral position can be found reliably by rotating the foot to a position of maximum pronation, then rotating the foot to a position of maximum supination, and determining the total rotation. The foot is then positioned one-third of the total angular rotation from maximum pronation toward maximum supination. This is the "neutral" position of the rearfoot bone complex.

Whenever one considers the control of reaction forces from floor or supporting surface 29 on the foot, it has been well known to be advantageous to try to control the movement of the heel or calcaneous in the shoe. It has long been demonstrated that eversion (pronation) of the heel decreases the skeletal stability of the longitudinal arch and that its maintenance becomes more dependent upon ligamentous and muscular support. When overstressed, these structures cause discomfort. This occurs in symptomatic flat feet and in the condition known as "painful calcaneal spur syndrome." The latter is often caused by prolonged abnormal tension of the plantar fascia at its attachment to the calcaneous. Relief of both these disorders can be obtained by the use of an orthotic device which prevents calcaneous 26 from assuming an excessively everted position. Such an orthotic device imparts greater skeletal stability to the foot and relieves the ligaments and musculature of the foot and leg of the task of furnishing the principle support for the longitudinal arch.

As the foot pronates or supinates from the neutral position, therefore, the muscles and ligaments are subjected to strain. Since during the normal course of activity this strain is not prolonged and the bone structure returns to the neutral position, the muscle structure in the lower foot readily can withstand such pronation and supination without injury. During prolonged walking, running or jogging, however, the weight being supported by the bones of the foot will be approximately 4 to 6 times the weight of the person when standing, as a result of the momentum of the body mass as each foot lands. When running takes place, therefore, the importance of the foot being in a neutral position increases substantially, and as the length or time during which running takes place increases, the chance of muscle strain resulting from abnormal supination or pronation of the bone structure and compensation by the muscles during running grows dramatically.

Unfortunately it is estimated that as much as 80% of the population have lower leg and rearfoot bone structures which are not aligned in the theoretical neutral relationship when weight bearing. Instead, variations from the ideal or the "normal" bone structure are more common than is the so-called "normal" structure.

The process of the present invention seeks to provide a shoe, and/or boot, in which the foot "abnormalities" can be accommodated so that the bone structure can be in the position for maximum efficiency of support of the weight of the athlete or non-athlete. The process is suitable and advantageous for use by someone having a "normal" foot structure, but it is particularly helpful in reducing and eliminating many maladies which are induced by conventional shoes that do not give any consideration to the possibility of abnormal or irregular bone structure.

Figure 10:
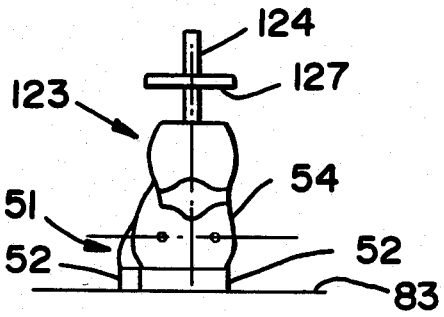
FIG. 10 is a rear elevational view of a shoe made from the positive model of FIG. 9.

In FIG. 10, a customized shoe constructed in accordance with the present invention is shown. The shoe, generally designated 51, includes an outer sole 52 which is in contact with the support surface 83. The insole of the shoe of the present invention, however, is not necessarily parallel to outer sole 52 or to surface 83. Instead, the insole conforms to the plantar surface (bottom) of the foot of the individual when the bone structure is in a neutral position. Thus, if the plantar surface of the foot is slightly inclined from a horizontal plane, as for example might occur when forefoot and/or subtalar varus are present, the insole of shoe 51 will mate with the plantar surface, even though the plantar surface is slightly angularly skewed or inclined to the horizontal.

Instead of attempting to force calcaneous 26 and talus 24 to a more vertical position, the shoe or boot of the present invention permits these bones to remain in a skewed alignment, but an alignment at which subtalar joint 27 and ankle joint 23 are positioned to maintain the most efficient function around the neutral position. An athlete or non-athlete using a shoe so constructed will have his foot impact the ground in a position for maximum efficiency for support of his weight. Accordingly, while the foot will pronate and supinate during the biomechanics of walking, running or skiing, that pronation and supination will occur about the neutral position, rather than pronation and supination from an abnormal non-neutral position, which would occur if conventional shoes were used by an individual having certain deformities of the forefoot and/or subtalar joint. The result, the use of a shoe, boot or bladder liner constructed in accordance with the present invention, will be that the muscles will be able to withstand the various activities with less strain and less likelihood of injury or damage.

The process and apparatus for forming a customized shoe or boot having a substantially optimal foot supporting construction can best be understood by reference to FIGS. 4 through 10. It is well known in the prior art to form customized shoes by taking an impression from the foot of the person who is going to wear the shoe, forming a mold or replica of the foot and subsequently forming the shoe around the replica. The process of the present invention does include the steps of taking an impression of the foot, producing a positive mold from the impression, and forming shoe, boot or inner bladder or liner for a shoe or boot to conform to the positive mold. These steps, per se, are not regarded as being a novel portion of the process of the present invention.

Figure 4:
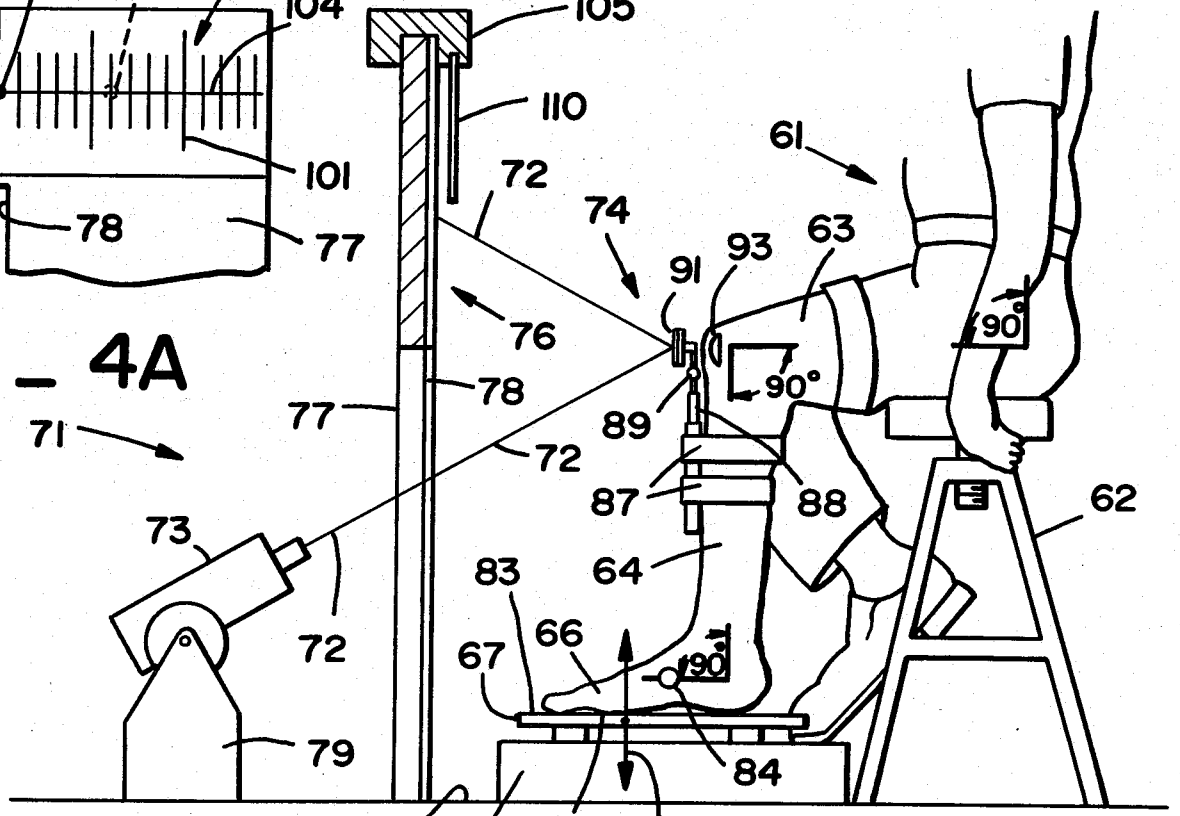
FIG. 4 is a side elevational view showing apparatus constructed in accordance with the present invention and being used with the left foot in accordance with the process of the present invention.
Figure 5:
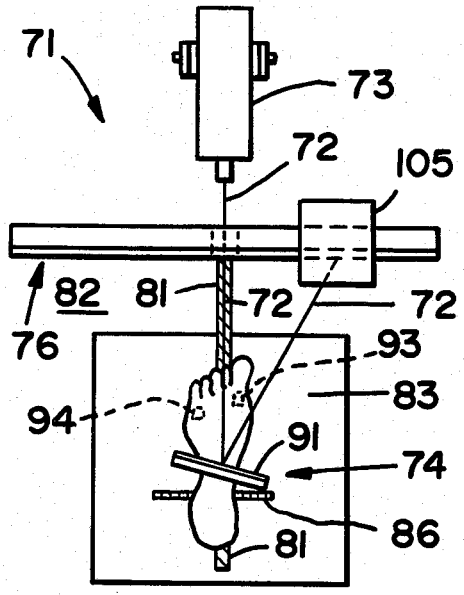
FIG. 5 is a top plan schematic view of the apparatus of FIG. 4 with the left foot shown in a pronated position.
Figure 6:
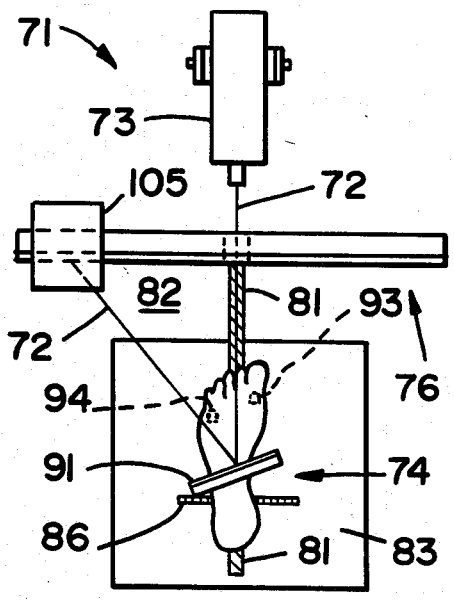
FIG. 6 is a top plan schematic view of the apparatus of FIG. 4 with the left foot shown in a supinated position.

In order to insure that the foot is optimally supported, however, the improved process of the present invention includes the step, at the start of the step of taking an impression of the foot, of positioning the rear foot complex of the bone structure of the foot in neutral position, and thereafter maintaining such bone structure in the neutral position until a permanent impression of the foot has been formed. As shown in FIGS. 4, 5 and 6, the positioning of the rear foot complex of the bone structure can be accomplished by sitting the individual 61 on a stool, chair or the like 62, with his upper leg 63 in a generally horizontal orientation and his lower leg 64 in a generally vertical orientation. This will result in approximately 90° angles betwen the body and upper leg 63, the upper leg and lower leg 64 and the lower leg and foot 66, as is indicated in the drawing. The foot 66 of the individual is positioned on a positioning platform 67 that is supported for vertical movement in the direction of arrows 68, so that the platform can be brought up into an even and uniform contact with foot 66. The support structure and vertical displacement apparatus 70 for platform 67 (for example, hydraulically or mechanically actuated cylinders) is not shown in detail for simplicity of illustration.

The process of the present invention can best be accomplished if the impression of the foot is formed, taken or made while the foot is in a semi-weight bearing condition. Thus, platform 67 should be adjusted until there is modest upward supporting pressure on foot 66. If the pressure is too great, molding platform 67 will tend to abnormally displace the bone structure of the feet in the same manner as would a conventional shoe. Thus, the pressure on foot 66 by platform 67 should not be so great as to deflect the rearfoot bone complex into a displaced position. In order to assist in this positioning process, knee block means (not shown) can be employed to limit the upward displacement of the knee. A bar extending transversely across the knee can be provided as the knee block means.

In addition to platform 67, the apparatus of the present invention includes a range-of-motion measuring device, generally designated 71, which is comprised of beam generating means 73, beam deflection means 74 and displacement measuring means 76. Thus, in its broadest aspect, the process of the present invention includes the step of employing range-of-motion measuring device 71 to determine when the rearfoot complex of the bone structure of foot 66 is in the neutral postion. Once the neutral position is located, the range-of-motion measuring device can be used to maintain the foot in the neutral position while a permanent impression of foot 66 is being taken.

It is well known that the neutral position of the rearfoot complex occurs at a position of one-third of the distance from the position of maximum pronation and the position of maximum supination. Accordingly, it is possible to sense the neutral positioning of the rearfoot complex by using a range-of-motion measuring device if the maximum supination and the maximum pronation which a foot will undergo while still being maintained on supporting platform 67 can be determined or sensed. In the preferred form of the present invention, sensing maximum pronation and maximum supination is accomplished by sensing the rotational motion of lower leg 64. Thus, as can be seen from FIGS. 2 and 3, rotation of the lower leg will accompany and produce rotation of the foot due to the mitered hinge configuration of the subtalar joint and vice versa. The apparatus of the present invention, therefore, includes beam deflection means 74, preferably in the form of a mirror, which is mounted removably to lower leg 64 so that rotation of lower leg 64 will deflect beam 72 laterally or medially in an amount that can be determined by beam displacement measuring means 76.

Once the maximum pronation and supination of foot 66 have been determined by sensing or measuring rotation of the leg of the individual, the leg can be rotated until it is one-third of the way from maximum pronation toward maximum supination, which will position the rearfoot complex in the neutral position.

In the preferred form of the present invention, beam generating means 73 is provided by a low energy laser, such as a helium-neon laser. One such device suitable for use in practicing the process of the present invention is Model 155 Helium-Neon Laser produced by Spectra-Physics, Inc. of Mountain View, Calif. This laser has an output power of 0.0005 watts and produces a 1/16 inch diameter beam having a light intensity of 0.025 watts/cm$^2$.

Laser 73 is mounted behind a structure which includes a lower screen portion 77, having a vertical slot 78 therein for passage of beam 72 therethrough, and upper beam displacement measuring portion 76. The individual is seated in front of screen portion 77 and measuring portion 76. Laser 73 is pivotally mounted on base 79 for adjustment along the sagittal (vertical) plane and is positioned so that beam 72 passes through ¼ inch vertical slot 78 in the central lower portion of the screen. As best can be seen in FIGS. 5 and 6, the beam is preferably perpendicular to screen 77 as it passes through slot 78. Screen portion 77 protects the subject against inadvertent exposure to the beam. Since the laser beam is low energy, there is only a theoretical danger to exposure of the eyes, which danger can be completely eliminated by the use of safety glasses.

The subject sits on a stool or chair with an adjustable height mechanism. The hip, knee and ankle joints are flexed at 90 degrees. A positioning line 81 (shown in FIGS. 5 and 6 lined for the color green), extending perpendicularly from the lower central edge of screen 77 directly below vertical slot 78, extends outwardly toward the subject along floor 82 and onto top surface 83 of positioning platform 67. The foot is oriented on this line so the line falls directly beneath the third toe and the vertical bisection of the posterior surface of the calcaneus. The distance foot 66 is placed from screen 77 is measured from the screen to the navicular tuberosity 84 of the foot (just in front and below the ankle bone as may be seen in FIG. 4). Typically this distance can be 28⅝ inches (73 centimeters), and a second line 86 (lined in red) may be provided on top surface 83 of platform 67.

The distance between the navicular tuberosity and the screen can be varied, but at 28⅝ inches a one-half inch displacement on screen 76 is equivalent to about 1° of angular rotation of the foot. Since screen 76 is flat, there will be a parallax effect at the edges. It should be noted that the scale on screen 76 can be a tangent function, i.e., it need not be linear, and the screen may also be curved to eliminate parallax.

Adjustable mirror 74 is securely strapped by bands 87 to the front of lower leg 64. The mirror is attached to a telescoping stem 88 to allow height adjustment, and a ball and socket type universal joint 89 is provided to enable adjustment of the reflecting surface 91 of the mirror on any plane. The stem is extended to the point at which the center of the mirror is directly in front of the center of patella 93 (FIG. 4). The plane of the mirror is initially adjusted to parallel the plane of the measuring surface 76.

Using reasonable care to prevent changing the orientation of the foot on positioning lines, 81 and 86, small pressure sensitive electronic switches 93 and 94 are taped directly to the skin beneath the first and fifth metatarsal heads, and the wire leads (not shown) from these switches can be taped to the dorsum of the foot and up the leg and connected to a signaling device away from the casting position.

A bracing device (not shown) may be optionally placed over and on adjacent sides of the knee to prevent motion of the leg in the frontal and sagittal planes. It is an important feature of the apparatus of the present invention, however, that measurements of the angular rotation of the leg by the present apparatus are not adversely affected by small lateral movements of the leg. Since mirror surface 91 is parallel to measuring surface 76, lateral movement of the knee of the subject does not deflect beam 72 either to the right or left of center. Only angular displacements about the vertical axis of lower leg 64 will cause swinging or angular deflection of beam 72 along measuring surface 76.

Positioning platform 67, with a replacement hard top surface 83, is raised to just contact plantar surface 98 of foot 66. The pressure on the bottom of the foot may be adjusted by incorporation of a pressure sensitive switch into surface 83.

Figure 4A:
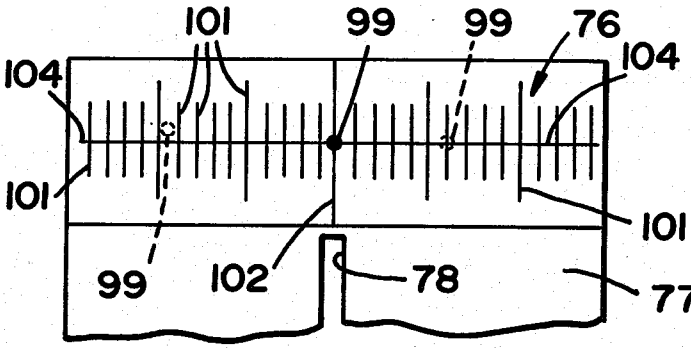
FIG. 4A is an enlarged, fragmentary front elevational view of the screen portion of the apparatus of FIG. 4.

Laser 73 is now turned on and beam 72 is adjusted in height so that it contacts the central portion of mirror surface 91. A final mirror adjustment is then made to reflect beam 72 onto a point in the exact center of the beam deflection measuring portion of the screen. The laser beam will be seen as a red dot 99 approximately $\frac{1}{8}$ inch (0.3 centimeters) in diameter on the measuring or sensing surface of the screen. In one form of the invention shown in FIG. 4A, measurement portion 76 includes a plurality of vertically extending lines 101 that are located at a calibrated distance from center line 102.

Returning now to the procedures for determining the neutral position, the subject is asked now to raise and lower his arch several times to its maximum height and depression. As the arch is raised, the foot supinates and the leg externally rotates, changing the angular relationship of the mirror relative to the calibrated screen portion 76. Axial rotations of the leg are directly transmitted to the foot and vice versa. Supination of the foot causes external rotation of the leg and pronation of the foot causes internal rotation. Laser beam 72 will reflect leg rotation onto the screen and laser "spot" 99 will move in a direction away from the zero central starting position 102.

Determination of the end points of motion will be provided by pressure switches 93 and 94 previously placed under foot 66. As the subject continues to raise the arch, ultimately the first metatarsal head will leave the supporting surface. At the instant this occurs, a signal is provided, and the position of the laser spot on the calibrated screen 76 may be noted. Upper screen portion 76 is shown with marker means 105 slidably mounted thereon. When switch 93 is actuated by raising the first metatarsal head, the position of spot 99 on the measuring scale can be marked by sliding marker means 105 across the screen until depending arm 110 is aligned with the spot. As the arch is lowered from its maximum height, the beam will reverse direction, pass through the zero point and move to the opposite side of the screen, as the leg internally rotates with pronation of the subtalar joint. The end point of motion in this direction is signaled electronically the instant the fifth metatarsal head leaves supporting surface 83. When this occurs, the position of laser spot 99 on calibrated screen 76 may again be marked by marker 105 and noted. The lines or calibrations 101 on screen portion 76 preferably consist of equidistant ($\frac{1}{2}$ inch) vertical lines sequentially numbered from 1 to 35, beginning adjacent to zero point 102 and extending to the right edge of the screen. Idential but symmetrical calibrations are to the left of the zero point extending to the opposite side of the screen. Preferably a total of 70 calibration lines are present on the screen.

To determine the excursion distance of the laser spot on the beam deflection measuring screen with internal and external rotation of the leg, the end points of the range of motion are added together. Thus, if with internal rotation spot 99 stops at the line designated "23" to the left of the zero point, and with external rotation, spot 99 stops at the line designated "11" to the right of the zero point, the total range of motion is the sum of these two figures, or 34. This method can be used if the laser spot crosses the zero point. If, with internal and external rotation, crossing zero fails to occur, the total range of motion is represented by subtracting the small from the larger figure. The use of vertically extending lines will insure better measurement, since there is some tendency for spot 99 to deviate upwardly or downwardly from horizontal line 104 as the beam is deflected to the right or left of center line 102.

In an alternate embodiment of the present invention lines 101 could consist of thin vertical strips of photoelectric cells, sensitive to laser light. These cells are integrated into an electrical circuit in which the beam is sensed electronically as it crosses the calibration strip. The number of strips crossed could then be counted electronically and digital readouts provided. Another alternative embodiment includes a lens system on laser 73 which produces a thin vertical strip of light on measuring screen portion 76. Instead of vertical lines on screen 76, the calibration numbers could be placed along a horizontal line, extending from one end of the screen to the other with the zero point again centrally located. As the vertical laser light strip scans the screen, it will intersect points on the horizontal line. The photoelectric sensors in this case could be very small and placed at fixed intervals along the horizontal line.

After having the subject go through several ranges of motion, the measurements resulting are averaged to determine the average range of motion. This figure is divided by 3 and the quotient is noted. Now the figures which designated the end points of the range of motion in the direction of pronation (internal leg rotation) are averaged and this figure is noted. The above quotient previously obtained is then subtracted from the average maximally pronated position. This difference represents the neutral position on the calibrated scale for that particular individual.

Keeping his foot in position, the subject internally or externally rotates his leg to position spot 99 at this computed neutral position on the scale, and the subject's foot will now be in its neutral position. In this position the foot is neither pronated nor supinated and the leg can externally rotate twice as far as it can internally rotate. Once the neutral position is established, the subject can hold his foot in this position while the foot is being casted, making only minor corrective adjustments to keep the laser beam on the designated calibration mark. Marker 105 can be used to assist maintenance of the neutral position. As long as the laser spot remains fixed, the foot will remain in its neutral position. If necessary, electronic feedback mechanisms can also be provided to alert the subject via visual or audible mechanisms when he is deviating from the neutral position, by how much, and in what direction, so that instantaneous corrective measures can be taken.

Just prior to the formation of an impression, the hard surfaced positioning platform 67 is replaced by a softer, more resilient casting surface. This is accomplished by lowering the platform, replacing positioning pad 67 with a resilient casting pad, and again raising the platform to the predetermined pressure. It is essential that no change in foot alignment occurs during completion of this maneuver. Therefore, similar alignment lines 81 and 86 are provided on the casting pad to exactly correspond in position to the lines marked on firm surface measuring platform used initially to position the foot. Moreover, the casting pad will have a casting material on it, such as strips 112 (FIG. 7) of a casting material that is pliable when placed in water in 140° F. and yet will become rigid in air at room temperature.

The foot is now realigned on the casting material on the casting pad, and the subject reassumes the neutral position by positioning the laser spot on the previously designated calibration point. The foot can now be cast or an impression made of the foot in the neutral position using materials such as Plaster of Paris and techniques well known in the art.

Figure 7:
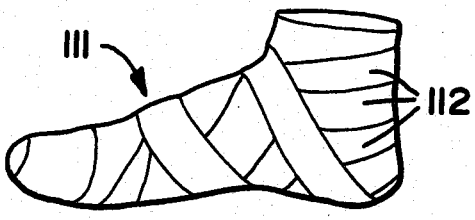
FIG. 7 is an enlarged, side elevational view of a negative cast or imprssion taken after positioning the foot with the apparatus of FIGS. 4 through 6.
Figure 8:
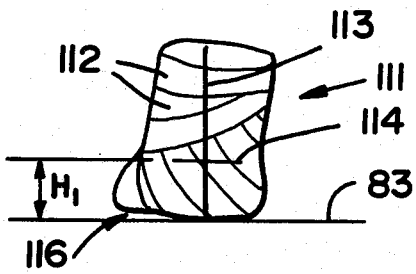
FIG. 8 is a rear elevational view of the impression of FIG. 7.
Figure 9:
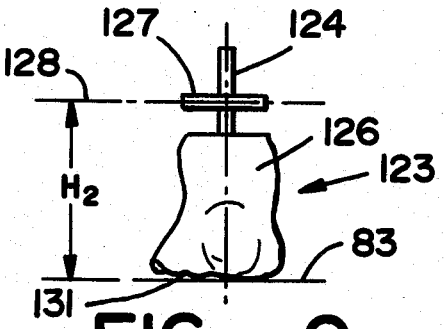
FIG. 9 is a rear elevational view of a positive model made from the impression of FIGS. 7 and 8.

FIGS. 7 and 8 illustrate an impression or negative model 111 which has been formed from sheets or strips 112 of molding material. Impression or negative model 111 can be cut or severed along various lines (not shown) so as to enable the same to be removed from foot 66 of the person for whom the customized shoes are being made.

In order to enable formation of footwear from an impression 111 that is properly oriented, the process of the present invention further includes the steps of forming indicia means on permanent impression 111 located in an indexed relation to at least one datum plane. Thus, as best may be seen in FIG. 8, indicia means in the form of a vertical plumb line 113 is provided bisecting the posterior surface of the heel of the impression or casting. Several forms of indicia means are suitable for use in the present invention; example, indicia means 113 can take the form of marks, protrusions, or recesses. Thus, line 113 will index the negative casting or impression 111 with respect to the vertical axis. Additionally, it is preferable that the casting include indicia or line 114, which is aligned in a plane parallel to the casting pad or surface 83. Formation of the indicia means 113 on model 111 can also be easily accomplished by use of a spirit level, which will provide both a horizon and a vertical axis along which markings can be placed.

The provision of means enabling orientation of the impression with respect to a vertical and with respect to a horizontal plane eventually will enable formation of the shoe or boot in a manner that will support the foot in exactly the same relationship to the horizontal and vertical planes as was achieved during casting of the impression while the rearfoot complex bones were in the neutral position. Additionally, it is advantageous for line 114 to be at a fixed or known height, $H_1$, from support surface 83. This spacing can then subsequently be used to permit the shoe or boot to have a known thickness of the sole. As will be seen in FIG. 8, the plantar aspect of the impression or casting 111 can be seen to be slightly upwardly tilted, displaced or inverted, as indicated by arrow 116, from the support surface 83.

Formation of a positive model from impression 111 can be accomplished in a number of different manners. Preferably, a release agent is sprayed on the inside surfaces of impression 111 and an epoxy (or other) resin or casting plaster can be poured into the impression and allowed to cure. Additionally, it is an important feature of the present invention that the means for orienting the impression be transferred to the positive model or replica. Thus, in FIG. 9 a positive model 123, which has been formed from impression 111, is shown. Model 123 includes a rodlike member or mandrel 124, which has been cast into the mass of epoxy or casting plaster 126 forming the model. Perpendicularly oriented to the rod 124 is a disc or cross bar or other horizontal structure 127. The rod 124 can be seen to be aligned with the plane of vertical center line 113. Thus, while the resin or plaster is still pliable, the rod 124 can be cast in general alignment with indicia 113 on the impression or negative casting 111. Since cross member 127 is perpendicular to rod 124, cross member 127 will fall on a plane 128 which is parallel to the plane of line 114.

It is further advantageous that cross member 127 be positioned from line 114 by a known distance during casting of positive model 123 so that the height, $H_2$, of the cross member 127 above horizontal reference surface 83 is also known. As can be seen from FIG. 9, the plantar surface or sole 131 of positive or replica 123 is slightly angulated from horizontal surface 83 when the model is indexed by rod 124 in a vertical orientation.

The final step in formation of footwear in accordance with the present invention is to orient positive model or replica 123 by means of the rod 124 in an indexed relation to a datum plane, such as horizontal surface 83, so that the shoe or boot formed about positive model 123 will support the foot in substantially the neutral position at which the impression was cast.

In recent years running shoes, and other shoes and boots, have been formed with soles 52 that are injection molded. Thus, an insole, not shown, can be placed underneath positive model 123, and shoe sole 52 injection molded so as to conform to the bottom surface 131 of the positive model. The height or thickness of the shoe can be varied by adjusting the position at which cross bar 127 is spaced from the bottom of an injection mold (not shown). Normally, the heel of the shoe is slightly elevated, e.g., by one half to three quarters of an inch (1.3 to 1.9 centimeters) from the plane 83 on which the shoe will eventually be supported. The toe portion of the model will be elevated by a somewhat smaller amount, e.g. $\frac{3}{8}$ to $\frac{1}{2}$ inches (1 to 1.3 centimeters). This produces a slight forward tilt in the shoe sole, but it can be accomplished without misalignment of the bone structure, as long as rod 124 is maintained in a vertical position.

Prior to injection molding (or hand pouring) sole 52, it is preferable that upper 54 be a string lasted upper which is pre-made to a certain size. The upper can be pulled down onto positive model 123 and tied to achieve a snug fit around and under the arch. The upper is then bonded to the sole 52 by injection molding, pouring or the like, the sole to the upper. This formation of sole 52 can be accomplished by employing a mold cavity for the sole material which adapts to the variable contours of positive model 123 of the foot. Such a variable sole cavity mold can be provided by using sliding plates or rods that move within a fixed frame and are hydraulically, pneumatically or mechanically urged against positive foot model 123.

Sole 52 of shoe 51 can be formed of a number of different materials including synthetic and natural rubbers, or a variety of plastics. It is preferable that the sole be injection molded using materials such as polyurethane, thermoplastic rubber or polyvinylchloride. Density can be varied so that the front and back portions of the sole can have a different density and hardness. Thus, the heel portion of the sole can be formed to be relatively harder and more dense than the flexible toe and ball portion of the sole. For moisture proofing, the upper may be advantageously formed of a TEFLON base material sold under the trademark GORE-TEX, which can also be provided with irridescent markings for night running or jogging.

It should also be noted that positive model 123 will conventionally conform so closely to the foot that formation of shoe 51 around the positive model can cause problems in the area of the toes if nothing more is done. Accordingly, it is further contemplated that a toe adaptation or spacer means (not shown) be added to the toe area of positive model 123 so that the toes of the foot will be recessed from the inside of the shoe by ½ to 1 inches (1.3 to 2.5 centimeters). Such a spacer means or toe adaptation will insure that during the dynamics of running, skiing or walking in which the skeletal structure of the foot elongates under the effective weight, the toes are not cramped or irritated by the inside of the shoe or boot.

Accordingly, shoe 51, a boot, or an inner liner for a shoe or boot can be built around the foot in the neutral position for support of that foot in the neutral position on a horizontal surface. This provides the most efficient and optimal support of the foot, particularly for athletic endeavors in which strain is heightened by acceleration of the body weight.

While the process and apparatus of the present invention have been described primarily in connection with the formation of a running shoe, it will be understood that they also can be used to form other types of footwear, such as boots, and particularly ski boots, or liners or bladder elements which can be placed inside a ski boot or shoes. Moreover, the apparatus and process of the present invention is particularly well suited for use in the formation of therapeutic footwear for people who have foot deformities or abnormalities.

What is claimed is:

1. A process for forming customized footwear including the steps of forming a mold directly on the foot of the subject, and forming footwear from said mold having at last a portion of the interior configuration of the footwear substantially conforming to the configration of the suject's foot, wherein the improvement in said process comprises:

at about the start of said step of forming said mold, directing a beam produced by range-of-motion apparatus against at last one of the subject's lower leg and foot, pronating and supinating the suject's foot through the maximum range of motion during said directing step, sensing the range of motion of said foot about the subtalar joint by a sensing element of said apparatus positioned to sense relative changes between said beam and said sensing element upon movement of the portion of the subject against which said beam is directed as a result of pronation and supination of said foot, generating an indicator signal when said foot is positioned at about one-third of the distance from the position of maximum pronation toward position of maximum supination, positioning the rearfoot complex of the bone structure of the foot in a neutral position upon generating of said indicator signal by said range-of-motion apparatus; and thereafter, maintaining said rear foot complex of the bone structure in said neutral position by continuing to sense any movement by said range-of-motion apparatus until said step of forming a mold includes forming a permanent impression of said foot in an indexed relation to a reference surface to enable said footwear to be formed during said footwear forming step with said interior configuration oriented with respect to the sole of said footwear for support of the subject's foot with the rearfoot complex of the bone structure in the neutral position.

2. The process for forming customized footwear as defined in claim 1 wherein, said directing step is accomplished by directing said beam against the subject's lower leg, and said sensing step is accomplished by coupling said sensing element to the subject's lower leg and sensing the range of pivotal motion of the lower leg of the subject by said range-of-motion apparatus.

3. A range-of-motion measuring apparatus suitable for positioning of the rearfoot complex of the bone structure of a subject's foot in a neutral position including, beam generating means formed to produce a directed beam and mounted for orientation of said beam against the subject, beam sensing means including an element formed for mounting to the subject in the area against which said beam is to be directed, said beam sensing means being further formed to sense the quantity of movement of the subject upon relative movement between said beam and said element, and formed to indicate positioning in a predetermined position over the range-of-motion of said rearfoot complex wherein the improvement in said range-of-motion measuring apparatus comprises:

platform means formed for vertical reciprocation and formed for receipt and support of the plantar surface of a foot thereon, and control means coupled to said platform means and formed to control the pressure of said plantar surface on said platform means by vertically displacing said platform means.

4. A range-of-motion measuring apparatus suitable for positioning of the rearfoot complex of the bone structure of a subject's foot in a neutral position comprising:

a laser formed to produce a directed beam amd mounted to direct said beam toward the lower leg of said suject;

beam sensing means formed to measure the quantity of movement of said lower leg during pronation and supination of said subject's foot about a neutral position and including a mirror mounted to said lower leg in a position intercepting said beam;

said laser being positioned to direct said beam toward said mirror in a vertical plane generally perpendicular to the plane of said mirror;

said sensing means further including horizontallly calibrated scale means mounted in juxtaposed relation to said mirror, said scale means being oriented initially generally parallel to said mirror for reflection of said beam by said mirror onto said scale means; and indicator means coupled to said sensing means and formed to indicate positioning of said lower leg in a predetermined position of the range-of-motion measured by said sensing means.

* * * * *